US010214805B2

(12) United States Patent
Williams et al.

(10) Patent No.: US 10,214,805 B2
(45) Date of Patent: Feb. 26, 2019

(54) ENHANCED ACTIVATION OF SELF-PASSIVATING METALS

(71) Applicants: Swagelok Company, Solon, OH (US); Case Western Reserve University, Cleveland, OH (US)

(72) Inventors: Peter C. Williams, Cleveland Heights, OH (US); Steven V. Marx, University Heights, OH (US); Frank Ernst, Cleveland Heights, OH (US); Anna V. Agaponova, Beachwood, OH (US)

(73) Assignees: SWAGELOK COMPANY, Solon, OH (US); CASE WESTERN RESERVE UNIVERSITY, Cleveland, OH (US)

( * ) Notice: Subject to any disclaimer, the term of this patent is extended or adjusted under 35 U.S.C. 154(b) by 804 days.

(21) Appl. No.: 14/813,290

(22) Filed: Jul. 30, 2015

(65) Prior Publication Data

US 2016/0032442 A1 Feb. 4, 2016

Related U.S. Application Data

(60) Provisional application No. 62/031,338, filed on Jul. 31, 2014.

(51) Int. Cl.

| | |
|---|---|
| ***C23C 8/02*** | (2006.01) |
| ***C23C 8/32*** | (2006.01) |
| ***C23C 8/26*** | (2006.01) |

(52) U.S. Cl.

CPC ..... *C23C 8/02* (2013.01); *C23C 8/26* (2013.01); *C23C 8/32* (2013.01)

(58) Field of Classification Search

CPC .... C23C 8/02; C23C 8/20; C23C 8/22; C23C 8/24

See application file for complete search history.

(56) References Cited

U.S. PATENT DOCUMENTS

| | | | |
|---|---|---|---|
| 3,232,797 | A | 2/1966 | Bessen |
| 4,844,949 | A | 7/1989 | Tohru et al. |
| 5,443,662 | A | 8/1995 | Arai et al. |
| 5,556,483 | A | 9/1996 | Tahara et al. |
| 5,593,510 | A | 1/1997 | Tahara et al. |
| 5,792,282 | A | 8/1998 | Tahara et al. |
| 6,093,303 | A | 7/2000 | Williams et al. |
| 6,165,597 | A | 12/2000 | Williams et al. |
| 6,547,888 | B1 | 8/2003 | Williams et al. |
| 8,414,710 | B2 | 4/2013 | Minemura et al. |
| 8,784,576 | B2 | 7/2014 | Somers et al. |
| 8,845,823 | B2 | 9/2014 | Christiansen et al. |
| 9,738,962 | B2 | 8/2017 | Bremer et al. |
| 2011/0123907 | A1 | 5/2011 | Yau |
| 2012/0111456 | A1 | 5/2012 | Christiansen et al. |

FOREIGN PATENT DOCUMENTS

| | | |
|---|---|---|
| CN | 1067929 | 1/1993 |
| CN | 102828145 | 12/2012 |
| EP | 787817 | 8/1997 |
| EP | 2278038 | 1/2011 |
| JP | 9071853 | 3/1997 |
| JP | 9268364 | 10/1997 |

OTHER PUBLICATIONS

Search Report from European Application No. 15828180.8 dated Feb. 20, 2018.

Stickels, "Gas Carburizing", ASM Handbook, vol. 4, Heat Treating, pp. 312-324, 1991.

Schaber et al., "Thermal decomposition (pyrolysis) of urea in an open reaction vessel", Thermochimica Acta 424, pp. 131-142 (2004).

International Search Report and Written Opinion from PCT/US15/42785 dated Oct. 28, 2015.

Office action from Chinese Application No. 201580040222.9 dated Aug. 14, 2018, dated Sep. 19, 2018.

"Heat Treatment of Materials and Surface Engineering", Shen Chengjin et al., China Mining University Press, p. 218.

*Primary Examiner* — Jessee R Roe

(74) *Attorney, Agent, or Firm* — Calfee, Halter & Griswold LLP

(57) ABSTRACT

A workpiece made from a self passivating metal and having one or more surface regions defining a Beilby layer as a result of a previous metal shaping operation is activated for subsequent low temperature gas hardening by exposing the workpiece to the vapors produced by heating an oxygen-free nitrogen halide salt.

26 Claims, No Drawings

ENHANCED ACTIVATION OF SELF-PASSIVATING METALS

CROSS-REFERENCE TO RELATED APPLICATION

This application claims the benefit of prior provisional patent application Ser. No. 62/031,338, filed Jul. 31, 2014, the priority of which is hereby claimed and the disclosure of which is incorporated herein by reference in its entirety.

BACKGROUND

Conventional Carburization

Conventional (high temperature) carburization is a widely used industrial process for enhancing the surface hardness of shaped metal articles ("case hardening"). In a typical commercial process, the workpiece is contacted with a carbon-containing gas at elevated temperature (e.g., 1,000° C. or more) whereby carbon atoms liberated by decomposition of the gas diffuse into the workpiece's surface. Hardening occurs through the reaction of these diffused carbon atoms with one or more metals in the workpiece thereby forming distinct chemical compounds, i.e., carbides, followed by precipitation of these carbides as discrete, extremely hard, crystalline particles in the metal matrix forming the workpiece's surface. See, Stickels, "Gas Carburizing", pp 312 to 324, Volume 4, *ASM Handbook*, © 1991, ASM International.

Stainless steel is corrosion-resistant because, as soon as the surface of the steel is exposed to the atmosphere, it immediately forms an impervious layer of chromium oxide. The steel is said to be self-passivating.

When stainless steel is traditionally carburized, the chromium content of the steel is locally depleted through the formation of the carbide precipitates responsible for surface hardening. As a result, there is insufficient chromium in near-surface areas immediately surrounding the chromium carbide precipitates to form the protective chromium oxide on the surface. Since the corrosion resistance of the steel is compromised, stainless steel is rarely case-hardened by conventional (high temperature) carburization.

Low Temperature Carburization

In the mid 1980's, a technique for case hardening stainless steel was developed in which the workpiece is contacted with a carbon-containing gas at low temperature, typically below ~550° C. At these temperatures, and provided that carburization does not last too long, carbon atoms liberated by decomposition of the gas diffuse into the workpiece surfaces, typically to a depth of 20-50 μm, without formation of carbide precipitates. Nonetheless, an extraordinarily hard case (surface layer) is obtained. Because carbide precipitates are not produced, the corrosion resistance of the steel is unimpaired, even improved. This technique, which is referred to a "low temperature carburization," is described in a number of publications including U.S. Pat. No. 5,556,483, U.S. Pat. No. 5,593,510, U.S. Pat. No. 5,792,282, U.S. Pat. No. 6,165,597, EPO 0787817, Japan 9-14019 (Kokai 9-268364) and Japan 9-71853 (Kokai 9-71853).

Nitriding and Carbonitriding

In addition to carburization, nitriding and carbonitriding can be used to surface harden various metals. Nitriding works in essentially the same way as carburization except that, rather than using a carbon-containing gas which decomposes to yield carbon atoms for surface hardening, nitriding uses a nitrogen containing gas which decomposes to yield nitrogen atoms for surface hardening.

In the same way as carburization, however, if nitriding is accomplished at higher temperatures and without rapid quenching, hardening occurs through the formation and precipitation of discrete compounds of the diffusing atoms, i.e., nitrides. On the other hand, if nitriding is accomplished at lower temperatures without plasma, hardening occurs without formation of these precipitates through the stress placed on the crystal lattice of the metal by the nitrogen atoms which have diffused into this lattice. As in the case of carburization, stainless steels are not normally nitrided by conventional (high temperature) or plasma nitriding, because the inherent corrosion resistance of the steel is lost when the chromium in the steel reacts with the diffusion nitrogen atoms to cause nitrides to form.

In carbonitriding, the workpiece is exposed to both nitrogen and carbon-containing gases, whereby both nitrogen atoms and carbon atoms diffuse into the workpiece for surface hardening. In the same way as carburization and nitriding, carbonitriding can be accomplished at higher temperatures, in which case hardening occurs through the formation of nitride and carbide precipitates, or at lower temperatures in which case hardening occurs through the sharply localized stress fields that are created in the crystal lattice of the metal by the interstitially dissolved nitrogen and carbon atoms that have diffused into this lattice. For convenience, all three of these processes, i.e., carburization, nitriding and carbonitriding, are collectively referred to in this disclosure as "low temperature surface hardening" or "low temperature surface hardening processes."

Activation

Because the temperatures involved in low temperature surface hardening are so low, carbon and/or nitrogen atoms will not penetrate the chromium oxide protective coating of stainless steel. Therefore, low temperature surface hardening of these metals is normally preceded by an activation ("depassivation") step in which the workpiece is contacted with a halogen containing gas such as HF, HCl, $NF_3$, $F_2$ or $Cl_2$ at elevated temperature, e.g., 200 to 400° C., to make the steel's protective oxide coating transparent to the passage of carbon and/or nitrogen atoms.

WO 2006/136166 (U.S. Pat. No. 8,784,576) to Somers et al., the disclosure of which is incorporated herein by reference, describes a modified process for low temperature carburization of stainless steel in which acetylene is used as the active ingredient in the carburizing gas, i.e., as the source compound for supplying the carbon atoms for the carburization process. As indicated there, a separate activation step with a halogen containing gas is unnecessary, because the acetylene source compound is reactive enough to depassivate the steel as well. Thus, the carburization technology of this disclosure can be regarded as self-activating.

WO 2011/009463 (U.S. Pat. No. 8,845,823) to Christiansen et al., the disclosure of which is also incorporated herein by reference, describes a similar modified process for nitrocarburizing stainless steel in which an "N/C compound" such as urea, formamide and the like is used as the source compound for supplying the nitrogen and carbon atoms needed for the carbonitriding process. The technology of this disclosure can also be considered to be self-activating, because a separate activation step with a halogen containing gas is also said to be unnecessary.

Surface Preparation and the Beilby Layer

Low temperature surface hardening is often done on workpieces with complex shape. To develop these shapes, some type of metal shaping operation is usually required such as a cutting step (e.g., sawing scraping, machining) and/or a wrought processing step (e.g., forging, drawing, bending, etc.). As a result of these steps, structural defects in the crystal structure as well as contaminants such as lubricants, moisture, oxygen, etc., are often introduced into the near-surface region of the metal. As a result, in most workpieces of complex shape, there is normally created a highly defective surface layer having a plastic deformation-induced extra-fine grain structure and significant levels of contamination. This layer, which can be up to 2.5 μm thick and which is known as the Beilby layer, forms immediately below the protective, coherent chromium oxide layer or other passivating layer of stainless steels and other self-passivating metals.

As indicated above, the traditional method for activating stainless steels for low temperature surface hardening is by contact with a halogen containing gas. These activating techniques are essentially unaffected by this Beilby layer.

However, the same cannot be said for the self-activating technologies described in the above-noted disclosures by Somers et al. and Christiansen et al. in which the workpieces are activated by contact with acetylene or an "N/C compound." Rather, experience has shown that, if a stainless steel workpiece of complex shape is not surface treated by electropolishing, mechanical polishing, chemical etching or the like to remove its Beilby layer before surface hardening begins, the self-activating surface hardening technologies of these disclosures either do not work at all or, if they do work somewhat, produce results which at best are spotty and inconsistent from surface region to surface region. As a practical matter, therefore, these self-activating surface hardening technologies cannot be used on stainless steel workpieces of complex shape unless these workpieces are pretreated to remove their Beilby layers first.

SUMMARY

In accordance with this invention, it has been found that this drawback of previously-known self-activating low temperature surface hardening processes when practiced on self-passivating metal workpieces carrying Beilby layers from previous metal shaping operations can be overcome by selecting an oxygen-free nitrogen halide salt as the source compound for activating the workpiece as well as supplying the nitrogen and optional carbon atoms needed for low temperature surface hardening.

In particular, it has been found in accordance with this invention that low temperature nitriding and carbonitriding can be made self activating if the source compound used to supply the nitrogen atoms for nitriding (as well as the carbon atoms for carbonitriding) is an oxygen-free nitrogen halide salt, even if the workpiece being nitrided or nitrocarburized is made from a self-passivating metal carrying a Beilby layer from a previous metal shaping operation.

Thus, this invention in one embodiment provides a process for activating a workpiece for subsequent carburizing, nitrocarburizing or nitriding, the workpiece being made from a self passivating metal and having one or more surface regions which include a Beilby layer as a result of a previous metal shaping operation, the process comprising exposing the workpiece to contact with vapors produced by heating an oxygen-free nitrogen halide salt to a temperature which is high enough to convert the oxygen-free nitrogen halide salt to vapors, the workpiece being exposed to these vapors at an activating temperature which is below a temperature at which nitride and/or carbide precipitates form for a time sufficient to activate the workpiece.

In addition, in another embodiment this invention provides a process for simultaneously activating and nitriding a workpiece made from a self passivating metal and having one or more surface regions which define a Beilby layer as a result of a previous metal shaping operation, the process comprising exposing the workpiece to contact with vapors produced by heating an oxygen-free nitrogen halide salt to a temperature which is high enough to convert the oxygen-free nitrogen halide salt to vapors, the workpiece being exposed to these vapors at a nitriding temperature which is high enough to cause nitrogen atoms to diffuse into the surfaces of the workpiece but below a temperature at which nitride precipitates faun, thereby nitriding the workpiece without formation of nitride precipitates.

In yet another embodiment, this invention provides a process for simultaneously activating and nitrocarburizing a workpiece made from a self passivating metal and having one or more surface regions which define a Beilby layer as a result of a previous metal shaping operation, the process comprising exposing the workpiece to contact with vapors produced by heating a carbon-containing oxygen-free nitrogen halide salt to a temperature which is high enough to convert the carbon-containing oxygen-free nitrogen halide salt to vapors, the workpiece being exposed to these vapors at a carbonitriding temperature which is high enough to cause nitrogen and carbon atoms to diffuse into the surfaces of the workpiece but below a temperature at which nitride precipitates or carbide precipitates form, thereby nitrocarburizing the workpiece without formation of nitride or carbide precipitates.

DETAILED DESCRIPTION

Definitions and Terminology

As indicated above, the fundamental difference between traditional (high temperature) surface hardening and the newer low temperature surface hardening processes first developed in the mid 1980's is that, in traditional (high temperature) surface hardening, hardening occurs as a result of the formation of carbide and/or nitride precipitates in the surfaces of the metal being hardened. In contrast, in low temperature surface hardening, hardening occurs as a result of the stress placed on the crystal lattice of the metal at the surfaces of the metal as a result of the carbon and/or nitrogen atoms which have diffused into these surfaces. Because the carbide and/or nitride precipitates responsible for surface hardening in traditional (high temperature) surface hardening are not found in stainless steels surface hardened by low temperature carburization, and further because low temperature surface hardening does not adversely affect the corrosion resistance of stainless steels, original thinking was that surface hardening occurs in low temperature carburization solely as a result of the sharply localized stress fields generated by interstitially dissolved carbon and/or nitrogen atoms which have diffused into the (austenitic) crystal structure of the steel.

However, recent more sophisticated analytical work has revealed that when low temperature surface hardening is carried out on alloys in which some or all of the alloy volume consists of ferritic phases, some type of previously-unknown nitride and/or carbide precipitate may form in small amounts in these ferritic phases. Specifically, recent analytical work suggests that in AISI 400 series stainless steels, which generally exhibit a ferrite phase structure, small amounts of previously unknown nitrides and/or carbides may precipitate when the alloy is low-temperature surface hardened. Similarly, recent analytical work suggests that in duplex stainless steels, which contain both ferrite and austensite phases, small amounts of previously unknown nitrides and/or carbides may precipitate in the ferrite phases of these steels when they are low temperature surface hardened. While the exact nature of these previously unknown, newly discovered nitride and/or carbide precipitates is still unknown, it is known that the ferrite matrix immediately surrounding these "para-equilibrium" precipitates is not depleted in its chromium content. The result is that the corrosion resistance of these stainless steels remains unimpaired, because the chromium responsible for corrosion resistance remains uniformly distributed throughout the metal.

Accordingly, for the purposes of this disclosure, it will be understood that when reference is made to a workpiece surface layer which is "essentially free of nitride and/or carbide precipitates," or to a workpiece which is surface hardened "without formation of nitride and/or carbide precipitates," or to a "temperature which is below a temperature at which nitride and/or carbide precipitates form," this reference refers to the type of nitride and/or carbide precipitates which are responsible for surface hardening in traditional (high temperature) surface hardening processes, which precipitates contain enough chromium so that the metal matrix immediately surrounding these precipitates loses its corrosion resistance as a result of being depleted in its chromium content. This reference does not refer to the previously-unknown, newly-discovered nitride and/or carbide precipitates which may form in small amounts in the ferrite phases of AISA 400 stainless steels, duplex stainless steels and other similar alloys.

Alloys

This invention can be carried out on any metal or metal alloy which is self-passivating in the sense of forming a coherent protective chromium-rich oxide layer upon exposure to air which is impervious to the passage of nitrogen and carbon atoms. These metals and alloys are well known and described for example in earlier patents that are directed to low temperature surface hardening processes, examples of which include U.S. Pat. No. 5,792,282, U.S. Pat. No. 6,093,303, U.S. Pat. No. 6,547,888, EPO 0787817 and Japanese Patent Document 9-14019 (Kokai 9-268364).

Alloys of special interest are the stainless steels, i.e., steels containing 5 to 50, preferably 10 to 40, wt. % Ni and enough chromium to form a protective layer of chromium oxide on the surface when the steel is exposed to air, typically about 10% or more. Preferred stainless steels contain 10 to 40 wt. % Ni and 10 to 35 wt. % Cr. More preferred are the AISI 300 series steels such as AISI 301, 303, 304, 309, 310, 316, 316L, 317, 317L, 321, 347, CF8M, CF3M, 254SMO, A286 and AL6XN stainless steels. The AISI 400 series stainless steels and especially Alloy 410, Alloy 416 and Alloy 440C are also of special interest.

Other types of alloys that can be processed by this invention are the nickel-based, cobalt based and manganese-based alloys which also contain enough chromium to form a coherent protective chromium oxide protective coating when the steel is exposed to air, typically about 10% or more. Examples of such nickel-based alloys include Alloy 600, Alloy 625, Alloy 825, Alloy C-22, Alloy C-276, Alloy 20 Cb and Alloy 718, to name a few. Examples of such cobalt-based alloys include MP35N and Biodur CMM. Examples of such manganese-based alloys include AISI 201, AISI 203EZ and Biodur 108.

Still another type of alloy on which this invention can be carried out are the titanium-based alloys. As well understood in metallurgy, these alloys form coherent protective titanium oxide coatings upon exposure to air which are also impervious to the passage of nitrogen and carbon atoms. Specific examples of such titanium-based alloys include Grade 2, Grade 4 and Ti 6-4 (Grade 5).

The particular phase of the metal being processed in accordance with the present invention is unimportant in the sense that this invention can be practiced on metals of any phase structure including, but not limited to, austenite, ferrite, martensite, duplex metals (e.g., austenite/ferrite), etc.

Activating with an Oxygen-free Nitrogen Halide Salt

In accordance with this invention, workpieces which are made from self-passivating metals and which exhibit complex shapes such that at least one surface region of the workpiece carries a Bielby layer are activated (i.e., depassivated) for simultaneous and/or subsequent low temperature surface hardening by contact of the workpiece with the vapors produced by heating an oxygen-free nitrogen halide salt. Surprisingly, we have found that such vapors, in addition to supplying nitrogen and optional carbon atoms for surface hardening, are so potent that they readily activate the surface of self-passivating metals notwithstanding the presence of a significant Bielby layer. Even more surprisingly, we have also found that workpieces activated in this way can be surfaced hardened in much shorter periods of time than possible in the past. For example, while it may take earlier processes for activation followed by low temperature surface hardening 24-48 hours to achieve a suitable case, the inventive process for activation followed by low temperature surface hardening can achieve a comparable case in as little as two hours.

Although not wishing to be bound to any theory, it is believed that this oxygen-free nitrogen halide salt decomposes either prior to and/or as a result of contact with the workpiece surfaces to yield both halide ions and nitrogen ions. These halide ions, it is believed, effectively activate the workpiece surfaces, while these nitrogen ions diffuse into the workpiece surfaces thereby hardening them through low temperature nitriding. If the oxygen-free nitrogen halide salt also contains carbon, carbon atoms are also liberated when the oxygen-free nitrogen halide salt decomposes, which carbon atoms also diffuse into the workpiece surfaces together with the nitrogen atoms. In this instance, the surfaces of the workpiece are hardened through low temperature carbonitriding.

It will therefore be appreciated that, when an oxygen-free nitrogen halide salt is used for activation in accordance with this invention, activation and nitriding occur simultaneously in the sense that it is unnecessary to supply an additional nitrogen containing compound for the nitriding process, as the oxygen-free nitrogen halide salt used for activation will supply the necessary nitrogen atoms for nitriding. In the same way, when a carbon-containing oxygen-free nitrogen halide salt is used for activation in accordance with this invention, activation and carbonitriding occur simultaneously in the sense that it is unnecessary to supply an additional compound or compounds containing both and carbon for carbonitriding, as the carbon-containing oxygen-free nitrogen halide salt will supply the necessary nitrogen and carbon atoms for this purpose.

On the other hand, additional nitrogen containing compounds which are capable of decomposing to yield nitrogen atoms for nitriding, additional carbon-containing compounds which are capable of decomposing to yield carbon atoms for carburization, additional compounds containing both carbon and nitrogen atoms which are capable of decomposing to yield both carbon atoms and nitrogen atoms for carbonitriding, or any combination of these, can be added to the system if desired to augment the nitriding, carburization and carbonitriding processes occurring as a result of the oxygen-free nitrogen halide salt. In some embodiments of this invention, these additional nitrogen-containing and/or carbon-containing compounds will be added after activation of the workpiece has been completed. In the context of this disclosure, this approach is referred to as "subsequent" low temperature nitriding, carburization and/or carbonitriding. In other embodiments of this invention, these additional nitrogen-containing and/or carbon-containing compounds can be added before activation of the workpiece has terminated or at the same time activation begins. In the context of this disclosure, these approaches are referred to a "simultaneous" low temperature nitriding, carburization and/or carbonitriding.

Another way of saying the above is that, either simultaneously with the activation of this invention or after this activation has been completed, the workpiece can be subjected to low temperature carburization, low temperature nitriding or low temperature nitrocarburizing in a conventional way to form a hardened surface or "case" on the workpiece surfaces. As well appreciated in the art, this is done by contacting the workpiece with compounds in the gas phase which are capable of decomposing to yield nitrogen atoms for nitriding, carbon atoms for carburization, or both nitrogen atoms and carbon atoms for carbonitriding, all under conditions which avoid formation of nitride precipitates or carbide precipitate. For convenience, these low temperature hardening processes are referred to in this disclosure, at least in some places, as "low temperature gas hardening" or "low temperature gas hardening processes."

The oxygen-free nitrogen halide salts that can be used for activation and surface hardening in accordance with this invention include any ionic compound which (1) includes a halide anion that provides the oxygen-free nitrogen halide salt with a room temperature solubility in water of at least 5 moles/liter, (2) contains at least one nitrogen atom, (3) contains no oxygen, and (4) vaporizes when heated to a temperature of 350° C. at atmospheric pressure. In this regard, note that the oxygen-free nitrogen and fluorine containing compound which has been used as an activating gas in earlier work, $NF_3$, is not an oxygen-free nitrogen halide salt in the context of this disclosure, since it is not ionic and hence not a salt.

Specific examples of oxygen-free nitrogen-halide salts which are useful for this purpose include ammonium chloride, ammonium fluoride, guanidinium chloride, guanidinium fluoride, pyridinium chloride and pyridinium fluoride. Nitrogen halide salts containing oxygen such as ammonium chlorate and ammonium perchlorate should be avoided, since the oxygen atoms they liberate on decomposition will interfere with activation (depassivation). In addition, chlorates and perchlorates should be avoided for the additional reason that they can be explosive when heated to elevated temperature.

In order to achieve workpiece activation in accordance with this invention, the workpiece is exposed to (i.e., contacted with) vapors that are produced when the oxygen-free nitrogen halide salt is vaporized by heating. This can be done at atmospheric pressure, above atmospheric pressures or subatmospheric pressures including a hard vacuum, i.e., at a total pressures of 1 ton (133 Pa (Pascals) or less as well as a soft vacuum, i.e., a total pressure of about 3.5 to 100 ton (~500 to ~13,000 Pa (Pascals)).

As indicated above, the exact mechanism that happens when this contact occurs is unclear as of this writing. However, what is clear is that the surfaces of these workpieces are effectively activated (i.e., depassivated) for simultaneous and/or subsequent carburization, nitriding and carbonitriding if contacted with these vapors at a suitable activation temperature for an appropriate length of time.

In this regard, it is well understood in low temperature surface hardening processes that if the workpiece is exposed to temperatures which are too high, unwanted nitride and/or carbide precipitates form. In addition, it is also understood that the maximum surface hardening temperature a workpiece can tolerate without forming these nitride and/or carbide precipitates depends on a number variables including the particular type of low temperature surface hardening process being carried out (e.g., carburization, nitriding or carbonitriding), the particular alloy being surface hardened (e.g., nickel-based vs. iron-bases alloys) and the concentration of the diffused nitrogen and/or carbon atoms in the workpiece surfaces. See, for example, commonly-assigned U.S. Pat. No. 6,547,888. So, it is also well understood that in carrying out low temperature surface hardening processes, care must be taken to avoid surface hardening temperatures which are too high in order that formation of nitride and/or carbide precipitates is avoided.

So, in the same way, in carrying out the inventive process, care should also be taken to insure that the temperature to which the workpiece is exposed during activation is not so high that unwanted nitride and/or carbide precipitates form. Generally, this means that the maximum temperature to which the workpiece is exposed during activation should not exceed about 500° C., preferably 475° C. or even 450° C., depending on the particular alloy being treated. So, for example, when nickel-based alloys are being surface hardened, the maximum activation temperature can typically be as high as about 500° C., as these alloys generally do not form nitride and/or carbide precipitates until higher temperatures are reached. On the other hand, when iron-based alloys such as stainless steels are being surface hardened, the maximum activation temperature should desirably be limited to about 450° C., as these alloys tend to become sensitive to the formation of nitride and/or carbide precipitates at higher temperatures.

In terms of minimum activation temperature, there is no real lower limit other than the fact that the temperatures of both the oxygen-free nitrogen halide salt and the workpiece itself must be high enough so that the oxygen-free nitrogen halide salt is in a vaporized state when it contacts the workpiece surfaces to be activated.

In terms of minimum activation time, in many instances, the inventive process will be carried out in such a way that the workpiece will continue to be exposed to vapors of the oxygen-free nitrogen halide salt during the entire low temperature thermal hardening process. In these instances, there is no minimum activation time, as activation continues to occur until the low temperature thermal hardening process ends.

However, in those instances in which contact of the workpiece with the oxygen-free nitrogen halide salt vapors terminates before the thermal hardening process ends, this contact should continue long enough so that the workpiece is effectively activated before contact between the workpiece and these vapors ends. This period of time can be easily determined by routine experimentation on a case-by-case basis. Generally speaking however, this contact should last at least about 10 minutes, more typically at least about 15 minutes, at least about 20 minutes, at least about 30 minutes, at least about 45 minutes, or at least about 1 hour.

The amount of oxygen-free nitrogen halide salt to use for activating a particular workpiece depends on the purpose for which this halide salt is being used. In those instances in which this salt is being used solely for the purposes of activation, the amount used need only be enough to achieve effective activation. On the other hand, in those instances in which this salt is being used both for the purpose of activation as well as for the purpose of supplying some or all of the nitrogen atoms needed for nitriding (or some or all of both the carbon atoms and the nitrogen atoms needed for carbonitriding), the amount used should be enough to satisfy both purposes. These amounts can vary considerably, as can be seen by comparing the following working Examples 13 and 14 in which the oxygen-free nitrogen halide salt was used primarily for activating with working Examples 1 to 3 in which the oxygen-free nitrogen halide salt was used for both activating and carbonitriding.

Thermal Hardening

Once the workpiece of the inventive process is sufficiently activated, it can be thermally hardened by established methods of low temperature nitriding, carburization and/or carbonitriding. That is to say, the manner in which the workpiece is processed once it is activated in terms of the reactors in which it is treated as well as the time, temperature, pressure and chemical composition of the reaction gas to which it is exposed inside the reactor for the hardening reaction are all conventional. In some instances, as indicated above, the workpiece can continue to be exposed to vapors of the oxygen-free nitrogen halide salt during some or all of the thermal hardening process. In other instances, if desired, this exposure can terminate such as, for example, by discontinuing the flow of oxygen-free nitrogen halide salt vapors to the reactor before thermal hardening is complete. In either situation, thermal hardening is accomplished in such a way as to create a case (i.e., a hardened surface layer) in the workpiece of a desired depth in a manner which avoids formation of carbide and/or nitride precipitates or their analogs in the case of other self-passivating metals.

Thus, when the particular thermal hardening process being carried out is nitriding, the workpiece will be exposed to a nitriding temperature which is high enough to cause nitrogen atoms to diffuse into the surfaces of the workpiece but below a temperature at which nitride precipitates form, thereby nitriding the workpiece without formation of nitride precipitates. Similarly, when the particular thermal hardening process being carried out is carburization, the workpiece will be exposed to a carburization temperature which is high enough to cause carbon atoms to diffuse into the surfaces of the workpiece but below a temperature at which carbide precipitates form, thereby carburizing the workpiece without formation of carbide precipitates. And when the particular thermal hardening process being carried out is carbonitriding, the workpiece will be exposed to a carbonitriding temperature which is high enough to cause nitrogen and carbon atoms to diffuse into the surfaces of the workpiece but below a temperature at which nitride precipitates or carbide precipitates form, thereby nitrocarburizing the workpiece without formation of nitride precipitates or carbide precipitates.

In a particularly interesting approach, activation and thermal hardening are accomplished in accordance with this invention in a closed system, i.e., in a reaction vessel which is completely sealed against the entry or exit of any material during the entire course of the activation and thermal hardening process. To insure that activation and thermal hardening are done properly, it is desirable that a sufficient amount of nitrogen halide salt vapors contact the surfaces of the workpiece that need to be activated, especially those surface regions which carry significant Beilby layers. Because the nitrogen halide salt that is used for both activation and thermal hardening in accordance with this invention will normally be a particulate solid, an easy way to insure this contact is done properly is by coating or otherwise covering these surfaces with this particulate solid and then sealing the reaction vessel before heating of the workpiece and oxygen-free nitrogen halide salt begins. The oxygen-free nitrogen halide salt can also be dissolved or dispersed in a suitable liquid and then coated onto the workpiece in this fashion.

These approaches are especially convenient when large batches containing many small workpieces such as ferrules and fitting for conduits and the like are thermally hardened at the same time in the same reaction vessel.

In some respects, the above approach of using a closed system resembles the technology described in U.S. Pat. No. 8,414,710 to Minemura et al. in which a self-passivating metal workpiece to be surface hardened is coated with an amino resin such as a melamine resin, a urea resin, an aniline resin or a formalin resin and then heated to depassivate and thermally harden the workpiece simultaneously. However, the thermal hardening processes shown there are conventional high temperature and plasma assisted nitriding and carburization processes. In addition, nitrogen halide salts are not shown or suggested. The approach of this invention differs from Minemura et al. in that a nitrogen halide salt is used not only to activate a self-passivating metal carrying a Beilby layer but also to surface harden this metal without forming carbide and/or nitride precipitates. The amino resins of Minemura et al. will not work for this purpose, it is believed.

In this regard, it has been found that other nitrogen and carbon-containing compounds which are more similar to the oxygen-free nitrogen halide salts of this invention than the amino resins of Minemura et al. are ineffective in terms of achieving the goals of this invention. So, for example, it has been found that guanidinium carbonate, cyanuric acid, imidazole and calcium cyanamide will not successfully activate workpieces made from AISI 316 stainless steels carrying Beilby layers for simultaneous low temperature carburization, even though they are similar in many respects to the oxygen-free nitrogen halide salts of this invention.

The approach of this invention in which activation and thermal hardening are carried out in a closed system as described above also resembles in some respects the technology disclosed in U.S. Pat. No. 3,232,797 to Bessen in which thin steel strip is coated with guanidinium compounds including guanidinium chloride and then heated to decompose the guanidinium compound and nitride the steel strip.

However, the thin steel strip being nitrided there is not self-passivating in the sense of forming a strongly-adherent, coherent protective oxide coating which is impervious to the passage of nitrogen and carbon atoms. Accordingly, the technology described there has little relevance to this invention in which stainless steel and other self-passivating metals which are impervious to the passage of nitrogen and carbon atoms are rendered transparent to these atoms by contact with the vapors of an oxygen-free nitrogen halide salt as part of a low temperature thermal hardening process.

Optional N/C Compound

As indicated above, WO 2011/009463 (U.S. Pat. No. 8,845,823) to Christiansen et al. teaches that stainless steels and other self-passivating metals can be low temperature carbonitrided by exposing the metal to the vapors generated by heating an "N/C compound" to decomposition. As further described there, no separate activation step with a halogen containing gas is said to be necessary, as the vapors generated from decomposition of these N/C compounds have been found to activate these metals as well. However, as further noted above, we have found that such compounds are incapable of achieving this activation in an effective way if the surface of workpiece being carbonitrided includes a Bielby layer.

On the other hand, in accordance with an optional feature of this invention, the activation procedure of this invention can be augmented by including one or more of these N/C compounds in the reaction system during the activation process, as it has been found that especially good results can be achieved by this approach. Additionally or alternatively, such N/C compounds can also be used for supplying some or all of the additional nitrogen and carbon atoms needed for subsequent carbonitriding. In this context, the additional nitrogen and carbon atoms needed for "subsequent" carbonitriding will be understood to refer to those carbon and nitrogen atoms which are consumed during carbonitriding that occurs after activation of the workpiece is essentially complete.

Suitable N/C compounds which can be used for this optional feature include those which (a) contain both nitrogen and carbon atoms, (b) contain at least one nitrogen to carbon bond, (c) contain at least four carbon atoms, and (d) exist in a solid or liquid state at a temperature of 25° C. and a pressure of 1 atmosphere (0.1 MPa). Specific compounds which are useful for this purpose include urea, acetamide and formamide, with urea being preferred.

The amount of this optional N/C compound that can used for practicing this feature of the invention depends on whether this compound is intended for use solely to augment activation or whether this compound is also intended for use in supplying nitrogen and carbon atoms for subsequent carbonitriding as well. In addition, it also depends on whether the amount of oxygen-free nitrogen halide salt included in the system is more than needed for activation and, if so, the amount of this excess.

In any event, in the former situation in which the optional N/C compound is intended for use solely to augment activation, the amount of this optional N/C compound used will typically be between 5 to 150 wt. %, more typically 25 to 125 wt. % or even 50 to 100 wt. % of the amount of oxygen-free nitrogen halide salt used.

In the later situation, the amount of this optional N/C compound that can used also depends on whether additional source compounds will be used for supplying some of the carbon and/or nitrogen atoms needed for subsequent carburization, nitriding or carbonitriding. In any event, in this situation, we have found that it is desirable that the amount of N/C compound used for both activation and subsequent carbonitriding exceed (or relate to) the amount of oxygen-free nitrogen halide salt used for activation by a factor of 0.5-1,000, more typically, 1-100, 1.5-50, 2-20 or even 2.5 to 15. In this regard, we have found that especially good results are achieved when practicing this optional feature of this invention if the N/C compound is used in excess of the oxygen-free nitrogen halide salt, this excess typically being by a factor 2-20, more typically 2.5 -15 or even 3-11 times the amount of oxygen-free nitrogen halide salt used.

Exposing the Workpiece to Atmospheric Oxygen

In still another embodiment of this invention, the workpiece is exposed to atmospheric oxygen after activation of the workpiece has been substantially completed.

As previously indicated, the traditional way in which stainless steel and other self-passivating metals are activated for low temperature carburization and/or carbonitriding is by contact of the workpiece with a halogen containing gas. In this regard, in some of the early work in this area as described in the afore-mentioned U.S. Pat. No. 5,556,483, U.S. Pat. No. 5,593,510 and U.S. Pat. No. 5,792,282, the halogen containing gases used for activation were restricted to fluorine-containing gases, in particular to HF, $F_2$ and $NF_3$ only. This is because when other halogen containing gases are used, especially chlorine-containing gases, the workpiece repassivates as soon as it is exposed to atmospheric oxygen between activation and thermal hardening. In contrast, when fluorine-containing gases are used for activation, this repassivation does not occur.

Fluorine-containing gases are very reactive, very corrosive and expensive, and so it is desirable to avoid using these gases to avoid these problems. On the other hand, using chlorine-containing gases for activation effectively requires that the workpiece not be exposed to the atmosphere between activation and thermal hardening which, in turn, dictates that activation and thermal hardening be carried out in the same furnace (reactor) as a practical matter. It can therefore be seen that there is an inherent trade-off between using fluorine-based activators and chlorine-based activators in connection with activating self-passivating metals for thermal hardening—fluorine-based activators involve undesirable corrosion and expense while chlorine-based activators restrict activation and thermal processing to the same furnace as a practical matter.

In accordance with another feature of this invention, this trade-off has been broken since it has been found that activated workpieces produced by this invention do not readily repassivate when exposed to atmospheric oxygen, even if the oxygen-free nitrogen halide salt used for activation is a chloride rather than a fluoride. That is to say, it has been found that chloride-based oxygen-free nitrogen halide salts act in the same way in this invention as fluoride-based oxygen-free nitrogen halide salts in terms of producing activated workpieces which do not readily repassivate when exposed to atmospheric oxygen, even if this exposure lasts 24 hours or longer.

As a result, it is no longer necessary to chose between using fluorine based activators, on the one hand, and carrying out activation and thermal processing in the same furnace, on the other hand, when activating workpieces for low temperature thermal hardening. On the contrary, when practicing this invention, activation and thermal processing can be carried out in two entirely separate and different furnaces if desired with no precaution being taken to avoid exposure of the workpiece to atmospheric oxygen, even if a chlorine-based activator is used. This approach, i.e., using separate activating and thermal processing furnaces, is inherently simpler, both in terms of furnace operation and capital costs, and hence makes the overall process less expensive to carry out.

As indicated above, exposure of the workpiece to atmospheric oxygen in accordance with this feature of the invention can occur anytime after activation of the workpiece has been substantially completed. What this means, in practical terms, is that this exposure should be delayed until the workpiece has been activated enough so that it will not undergo substantial repassivation when exposure to atmospheric oxygen occurs. In other words, this exposure should not occur so soon that a major negative impact is caused on the operation of the subsequent low temperature thermal hardening process due to using a workpiece that has been inadequately activated. Other than this constraint, however, exposure of the workpiece to atmospheric oxygen invention can occur anytime, including after the subsequent low temperature thermal hardening process has begun.

Normally, however, exposure to atmospheric oxygen will occur between activation and low temperature thermal hardening as a normal consequence of taking the workpiece out of its activation furnace for transfer to a separate thermal hardening furnace.

WORKING EXAMPLES

In order to more thoroughly describe this invention, the following working examples are provided.

Example 1

A cut portion of an as-machined ferrule made from an AISI 316 stainless steel, ½ inch (1.27 cm) in diameter was encapsulated with 10 g of guanidinium chloride in an evacuated (1 to 2 Pa) 12 mm diameter glass ampoule 210 mm long. The ampoule was heated in a furnace to 720° K (447° C.) at a rate of 50° K/min volatilizing the guanidinium chloride. After two hours at 720° K, the ampoule was removed from the furnace and rapidly cooled. Subsequent metallography of the cross sectioned ferrule revealed the diffusion formation of a 37 μm deep carbonitrided case with a near surface hardness of 1000 Vickers (25 g indent load).

Examples 2 and 3

Example 1 was repeated for a second and third time. On the second run the case depth was found to be 38 microns deep with a near surface hardness of 1300 Vickers. On the third run the case depth was found to be 36 μm with a near surface hardness of 1200 Vickers. These examples demonstrate that the technology of this invention is highly reproducible.

Example 4

Example 1 was repeated, except that the workpiece (i.e., the cut portion of an as-machined ferrule) was encapsulated with 0.01 g of $NH_4Cl$ and 0.11 grams of urea, the glass ampoule was 220 mm long, and the ampoule was heated to 450° C. for 120 minutes. This example was run four separate times. The nitrocarburized workpieces obtained all exhibited a near surface hardness of about 1200 Vickers and a uniform case depth of 15 μm, 18 μm, 18 μm and 20 μm, respectively.

Example 5

Example 4 was repeated, except that the workpiece was encapsulated with 0.01 g of guanidinium chloride and 0.11 g of urea. This example was also run four separate times. The nitrocarburized workpieces obtained all exhibited a near surface hardness of about 1100 Vickers and a uniform case depth of 20 μm, 21 μm, 22 μm and 18 μm, respectively.

Example 6

Example 4 was repeated, except that the workpiece was encapsulated with 0.01 g of pyridinium chloride and 0.11 g of urea. This example was run only once and produced a nitrocarburized workpiece exhibiting a near surface hardness of about 900 Vickers and a uniform case depth of 13 μm.

Example 7

Example 6 was repeated, except that the workpiece was encapsulated with 0.09 g of urea and 0.03 grams of a salt mixture comprising 10 wt. % pyridinium chloride, 10 wt. % guanidinium chloride and 80 wt. % $NH_4Cl$, and the workpiece was heated first to 250° C. for 60 minutes followed by further heating to 450° C. for 120 minutes. The nitrocarburized workpiece produced exhibited a near surface hardness of about 850 Vickers and a uniform case depth of 14 μm.

Example 8

Example 7 was repeated, except that the workpiece was made from alloy 825 Incoloy. The nitrocarburized workpiece produced exhibited a near surface hardness of about 600 Vickers and a uniform case depth of 12 μm.

Example 9

Example 8 was repeated, except that the workpiece was made from alloy 825 Inconel. The nitrocarburized workpiece produced exhibited a near surface hardness of about 600 Vickers and a uniform case depth of 10 μm.

Example 10

An as-machined ¼ inch alloy 625 Inconel ferrule was encapsulated with 0.093 g urea, 0.003 g of guanidinium chloride, and 0.024 g $NH_4Cl$ in an evacuated 12 mm glass ampoule 220 mm long, which was then heated to 500° C. for 120 minutes. Two runs of this experiment were conducted. Both nitrocarburized workpieces produced exhibited a near surface hardness of about 1100 Vickers, while one of these workpieces exhibited a uniform case depth of 14 microns and the other exhibited a uniform case depth of 11 μm.

Example 11

Example 10 was repeated, except that the workpieces were made from cut portions of an as-machined ½ inch alloy 825 Incoloy ferrule. The nitrocarburized workpiece produced by both runs exhibited a near surface hardness of about 1250 Vickers and a uniform case depth of 20 μm and 22 μm, respectively.

Example 12

Three separate workpieces, one comprising a cut portion of an as-machined ferrule made from an AISI 316 stainless steel ½ inch (1.27 cm) in diameter, the second comprising an as-machined ¼ inch alloy 625 Inconel ferrule, and the third comprising a cut portion of an as-machined 1/2 inch alloy 825 Incoloy ferrule, were placed together in an open-ended 12 mm glass cylinder 250 mm long. In addition, 0.63 g guanidinium chloride, 5.0 g $NH_4Cl$ and 19.4 g urea were also placed in this open-ended glass tube. The tube was then heated at 470° C. for 120 minutes.

The nitrocarburized product obtained from the AISI 316 stainless steel ferrule exhibited a uniform case depth exhibiting a depth of 12 μm and a near surface hardness of about 1000 Vickers. Meanwhile, the nitrocarburized product obtained from the as-machined alloy 625 Inconel ferrule exhibited a uniform case depth exhibiting a depth of 8 μm and a near surface hardness of about 800 Vickers, while the nitrocarburized product obtained from the as-machined alloy 825 Incoloy ferrule exhibited a uniform case depth exhibiting a depth of 11 μm and a near surface hardness of about 1200 Vickers.

This example shows that even with the furnace open to ambient air, the concurrent nitrogen chloride salt activation and low temperature urea based carbonitriding proceeded nonetheless. That is to say, oxygen from the ambient air did little to impede the effective activation of these self-passivating metals for low temperature carbonitriding.

Example 13

Two separate workpieces, each comprising a cut portion of an as-machined ferrule made from an AISI 316 stainless steel, ½ inch (1.27 cm) in diameter, were encapsulated in the same 12 mm diameter 220 mm long ampoule which also contained 0.13 g of $NH_4Cl$. The ampoule was evacuated to a pressure of 1 to 2 Pa, sealed and then heated in an activation furnace to 350° C. for 60 minutes. The ampoule was then allowed to cool, broken open, and the two workpieces therein transported in the open atmosphere to two separate carburization furnaces located some miles apart from one another.

After being exposed to the open atmosphere for about 24 hours, each workpiece was subjected to low temperature carburization by contact with a carburization gas for 16 hours at 450° C. The carburizing gas used in the first carburizing furnace was composed of 27% acetylene, 7% $H_2$ and 66% $N_2$. Meanwhile, the carburizing gas used in the second carburizing furnace was composed of 50% acetylene and 50% $H_2$.

The carburized workpiece produced by the first carburization furnace exhibited a near surface hardness of about 1000 Vickers and a uniform case depth of 20 μm, while the carburized workpiece produced by the second carburization furnace exhibited a near surface hardness of about 750 Vickers and a uniform case depth of 20 μm.

This example shows that, even though oxygen-free nitrogen halide salt used for activating the workpiece was chlorine based, the activated workpiece was essentially unaffected by exposure to atmospheric oxygen.

Example 14

Example 13 was repeated, except that the ampoule containing the two workpieces was heated for 90 minutes at 350° C. The carburized workpiece produced by the first carburization furnace exhibited a near surface hardness of about 1000 Vickers and a uniform case depth of 20 μm, while the carburized workpiece produced by the second carburization furnace exhibited a near surface hardness of about 800 Vickers and a uniform case depth of 20 microns.

Although only a few embodiments of this invention have been described above, it should be appreciated that many modifications can be made without departing from the spirit and scope of this invention. All such modifications are intended to be included within the spirit and scope of this invention, which is to be limited only by the following claims.

The invention claimed is:

1. A process for activating a workpiece for subsequent low temperature carburizing, nitrocarburizing or nitriding, the workpiece being made from a self passivating metal and having one or more surface regions which define a Beilby layer as a result of a previous metal shaping operation, the process comprising exposing the workpiece to contact with vapors produced by heating an oxygen-free nitrogen halide salt to a temperature which is high enough to convert the oxygen-free nitrogen halide salt to vapors, the workpiece being exposed to these vapors at an activating temperature which is below a temperature at which nitride and/or carbide precipitates form for a time sufficient to activate the workpiece.

2. The process of claim 1, wherein the oxygen-free nitrogen halide salt is an ionic compound which (1) includes a halide anion that provides the oxygen-free nitrogen halide salt with a room temperature solubility in water of at least 5 moles/liter, (2) contains at least one nitrogen atom, (3) contains no oxygen, and (4) vaporizes when heated to a temperature of 350° C. at atmospheric pressure.

3. The process of claim 2, wherein the oxygen-free nitrogen halide salt is ammonium chloride, ammonium fluoride, guanidinium chloride, guanidinium fluoride, pyridinium chloride, pyridinium fluoride or mixtures thereof.

4. The process of claim 3, wherein the oxygen-free nitrogen halide salt is ammonium chloride, guanidinium chloride or mixtures thereof.

5. The process of claim 4, wherein the oxygen-free nitrogen halide salt is ammonium chloride.

6. The process of claim 4, wherein the oxygen-free nitrogen halide salt is guanidinium chloride.

7. The process of any preceding claim 1, wherein the workpiece is made from stainless steel.

8. The process of claim 7, wherein the stainless steel is an AISI 316 stainless steel.

9. The process of claim 1, wherein the workpiece and the oxygen-free nitrogen halide salt are heated together in a closed system.

10. The process of claim 1, wherein the workpiece is exposed to said vapors under conditions of time and temperature which are sufficient to cause nitrogen atoms to diffuse into the surfaces of the workpiece, thereby nitriding the workpiece without formation of nitride precipitates.

11. The process of claim 10, wherein the oxygen-free nitrogen halide salt contains carbon, and further wherein the workpiece is exposed to said vapors under conditions of time and temperature which are sufficient to cause both nitrogen atoms and carbon atoms to diffuse into the surfaces of the workpiece, thereby nitrocarburizing the workpiece without formation of nitride precipitates or carbide precipitates.

12. The process of claim 10, further comprising subjecting the workpiece to a low temperature gas hardening process selected from the group consisting of low temperature carburization, low temperature nitriding and low temperature nitrocarburizing, thereby forming a hardened surface layer on the workpiece surfaces without formation of nitride or carbide precipitates, said low temperature gas hardening process being carried out by contacting the workpiece with an additional gas different from said vapors, said additional gas containing at least one of a compound capable of decomposing to yield nitrogen atoms for nitriding, a compound capable of decomposing to yield carbon atoms for carburization, and a compound capable of decomposing to yield both nitrogen atoms and carbon atoms for nitrocarburizing.

13. The process of claim 12, wherein the workpiece is contacted with the additional gas only after the workpiece has been activated.

14. The process of claim 12, further comprising exposing the workpiece to atmospheric oxygen after the workpiece has been activated.

15. The process of claim 14, wherein the oxygen-free nitrogen halide is a chloride.

16. The process of claim 14, wherein activation of the workpiece is carried out in an activation furnace, wherein low temperature gas hardening is accomplished in a thermal processing furnace which is different from the activation furnace, and wherein the workpiece is exposed to atmospheric oxygen while being transferred between the activation furnace and the thermal processing furnace.

17. The process of claim 16, wherein the oxygen-free nitrogen halide is a chloride.

18. The process of claim 1, further comprising subjecting the workpiece to a low temperature gas hardening process selected from the group consisting of low temperature carburization, low temperature nitriding and low temperature nitrocarburizing, thereby forming a hardened surface layer on the workpiece surfaces without formation of nitride or carbide precipitates, said low temperature gas hardening process being carried out by contacting the workpiece with an additional gas different from said vapors, said additional gas containing at least one of a compound capable of decomposing to yield nitrogen atoms for nitriding, a compound capable of decomposing to yield carbon atoms for carburization, and a compound capable of decomposing to yield both nitrogen atoms and carbon atoms for nitrocarburizing.

19. The process of claim 18, wherein the workpiece is contacted with the additional gas only after the workpiece has been activated.

20. The process of claim 18, further comprising exposing the workpiece to atmospheric oxygen after the workpiece has been activated.

21. The process of claim 20, wherein the oxygen-free nitrogen halide is a chloride.

22. The process of claim 20, wherein activation of the workpiece is carried out in an activation furnace, wherein low temperature gas hardening is accomplished in a thermal processing furnace which is different from the activation furnace, and wherein the workpiece is exposed to atmospheric oxygen while being transferred between the activation furnace and the thermal processing furnace.

23. The process of claim 22, wherein the oxygen-free nitrogen halide is a chloride.

24. The process of claim 1, further comprising exposing the workpiece to atmospheric oxygen.

25. The process of claim 24, wherein the oxygen-free nitrogen halide is a chloride.

26. The process of claim 25, wherein the workpiece is exposed to atmospheric oxygen before subsequent low temperature carburizing, nitriding or nitrocarburizing.

* * * * *